US007061439B1

(12) United States Patent
Minami et al.

(10) Patent No.: US 7,061,439 B1
(45) Date of Patent: Jun. 13, 2006

(54) ANTENNA, WATCH PROVIDED WITH THE ANTENNA, AND METHOD OF MANUFACTURING THE ANTENNA

(75) Inventors: Narutoshi Minami, Mitaka (JP); Takashi Sano, Fussa (JP); Soh Kimura, Kodaira (JP); Hirokazu Araki, Kitamoto (JP); Masahiro Mita, Fukaya (JP); Tadashi Kotani, Tottori (JP); Takayuki Ishimoto, Tottori (JP)

(73) Assignees: Casio Computer Co., Ltd., Tokyo (JP); Hitachi Ferrite Electronics, Ltd., Tottori (JP); Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 11/221,132

(22) Filed: Sep. 6, 2005

(30) Foreign Application Priority Data

Nov. 26, 2004 (JP) ..... 2004-342916

(51) Int. Cl.
*H01Q 7/08* (2006.01)
*H01Q 1/12* (2006.01)

(52) U.S. Cl. ..... 343/718; 343/788

(58) Field of Classification Search ..... 343/788, 343/787, 718, 866, 741; H01Q 1/12, 7/08
See application file for complete search history.

(56) References Cited

U.S. PATENT DOCUMENTS 4,947,179 A * 8/1990 Ganter et al. ..... 343/718
6,914,564 B1 * 7/2005 Barras et al. ..... 343/700 MS
6,987,490 B1 * 1/2006 Sano ..... 343/788
2004/0201535 A1 10/2004 Sano
2005/0116872 A1 * 6/2005 Minami et al. ..... 343/788
2005/0248493 A1 * 11/2005 Sano ..... 343/718

FOREIGN PATENT DOCUMENTS

| | | | |
|---|---|---|---|
| EP | 1 500 991 | A2 | 1/2005 |
| JP | 55-91237 | A | 7/1980 |
| JP | 2004-104551 | A | 4/2004 |
| JP | 2004-128956 | A | 4/2004 |
| JP | 2004-179803 | A | 6/2004 |
| JP | 2005-65151 | A | 3/2005 |
| WO | PCT WO 95/27928 | A1 | 10/1995 |
| WO | WO 2005/053096 | A1 | 6/2005 |

* cited by examiner

*Primary Examiner*—Hoanganh Le
(74) *Attorney, Agent, or Firm*—Frishauf Holtz Goodman & Chick P.C.

(57) ABSTRACT

An antenna includes an elongate laminated core, a core case having an electrical insulating property and housing the core, and a coil wound around the core between both end portions of the core through the case. The core has a first and second groups, each including thin plates of amorphous soft magnetic alloy laminated with each other, and is configured by stacking the first and second groups one another. Each of the thin plates of the core includes flanges provided at both end portions thereof, and a coil wound portion between the both end portions, and the case includes projections, which push the both end portions of the thin plates of the second group to separate from the both end portions of the thin plates of the first group in the laminating direction of the thin plates of the core while the core is housed in the case.

15 Claims, 8 Drawing Sheets

ANTENNA, WATCH PROVIDED WITH THE ANTENNA, AND METHOD OF MANUFACTURING THE ANTENNA

CROSS-REFERENCE TO RELATED APPLICATIONS

This application is based upon and claims the benefit of priority from prior Japanese Patent Application No. 2004-342916, filed Nov. 26, 2004, the entire contents of which are incorporated herein by reference.

BACKGROUND OF THE INVENTION

1. Field of the Invention

This invention relates to an antenna, a watch provided with the antenna, and a method of manufacturing the antenna.

2. Description of the Related Art

A timepiece, which receives a radio wave including standard time information (hereinafter called a standard time radio wave) and corrects time automatically, has been used in recent years, and this kind of timepiece is called as a radio controlled timepiece. In Japan, two standard time radio wave stations transmit standard time radio waves in long waves of 40 kHz and 60 kHz.

Therefore, a radio controlled timepiece designed for use in Japan contains an antenna to receive the standard time radio waves of 40 kHz and/or 60 kHz.

Like ordinary timepieces, there are two types of radio controlled timepieces, one of which is a clock type including a table clock and a wall clock, and the other of which is a watch type including a wristwatch and a pocket watch.

The watch type radio controlled timepiece, which is very smaller than the clock type radio controlled timepiece, must use an antenna, which is very smaller than that used in the clock type radio controlled timepiece, for receiving the standard time radio waves. Further, if a case of the watch type radio controlled watch is made of metal such as titanium and stainless steel, the antenna used in the watch type radio controlled timepiece must be superior to that used in the clock type radio controlled watch in a radio wave receiving characteristic.

FIGS. 11 and 12 show a schematic longitudinal sectional view and plan view of two types of conventional antennas for receiving the standard time radio waves used in the watch type radio controlled time pieces.

The conventional antenna 51 for receiving the standard time radio waves shown in FIG. 11 is widely known by the Japanese Patent Application KOKAI Publication No. 2004-179803, and uses a laminated core 52 formed by laminating many amorphous soft magnetic alloy thin plates. On the laminated core 52, a coil 53 is wound between both end portions thereof. To increase the Q-value (ratio of output to input) indicating the receiving characteristic of the antenna 51, the laminated amorphous soft magnetic alloy thin plates are separated into two groups by spacers 54 in the laminating direction at both end portions of the laminated core 52.

The conventional antenna 61 for receiving the standard time radio waves shown in FIG. 12 is widely known by the Japanese Patent Application KOKAI Publication No. 2004-104551, and uses a laminated core 62 formed by laminating many amorphous soft magnetic alloy thin plates. On the laminated core 62, a coil 63 is wound between both end portions thereof. The conventional antenna 61 for receiving the standard time radio waves forms a closed loop by bending both end portions 65 of the laminated core 62 to come close to each other, in order to reduce a magnetic flux to leak to a metallic case 64 of a watch type radio controlled timepiece while the antenna is placed in the inside space of the metallic case 64.

In the conventional antenna 51 for receiving the standard time radio waves shown in FIG. 11, it is troublesome and requires much time to separate the laminated thin plates into desired two groups in the laminating direction at both end portions of the laminated core 52 by the spacers 54.

In the conventional antenna 61 for receiving the standard time radio waves shown in FIG. 12, the structure to form the laminated core 62 into the closed loop prevents the antenna 61 from being miniaturized.

BRIEF SUMMARY OF THE INVENTION

According to an aspect of the invention, an antenna comprises: an elongate laminated core, which has a first group including a plurality of thin plates of amorphous soft magnetic alloy laminated with each other and a second group including a plurality of thin plates of amorphous soft magnetic alloy laminated with each other and which is configured by stacking the first and second groups one another; a core case, which has an electrical insulating property and houses the laminated core; and a coil, which is wound around the laminated core between both end portions of the laminated core through the core case. Each of the thin plates of the laminated core includes flanges provided at both end portions thereof, and a coil wound portion provided between the both end portions, and the core case includes projections, which push the both end portions of the thin plates of the second group to separate from the both end portions of the thin plates of the first group in the laminating direction of the thin plates of the laminated core while the laminated core is housed in the core case.

According to an aspect of the invention, a watch comprises: the antenna described above; a time measuring and displaying mechanism, which measures and displays the time; and a watchcase, which houses the antenna and the time measuring and displaying mechanism. The antenna receives a standard time radio wave, and the time measuring and displaying mechanism corrects the displaying time according to the standard time radio wave received by the antenna.

According to an aspect of the invention, a method of manufacturing an antenna, comprises: preparing a laminated core, in which a first group prepared by laminating elongate thin plates with each other and a second group prepared by laminating elongate thin plates with each other are stacked one another, each elongate thin plate of the first and second group being made of amorphous soft magnetic alloy and provided with flanges at both end portions thereof and a coil wound portion between the both end portions; housing the laminated core in a core case having an electrically insulating property and having projections, and pushing the both end portions of the thin plates of the second group to separate from the both end portions of the thin plates of the first group in the laminating direction of the thin plates in the laminated core by the projections of the core case; and winding an electric wire around the laminated core between the both end portions of the laminated core housed in the core case through the core case.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One Embodiment of Antenna

First, one embodiment of an antenna according to the present invention will be explained with reference to FIGS. 1A to 8. The antenna of this embodiment is used for receiving Japanese standard time radio waves.

Figure 1A:
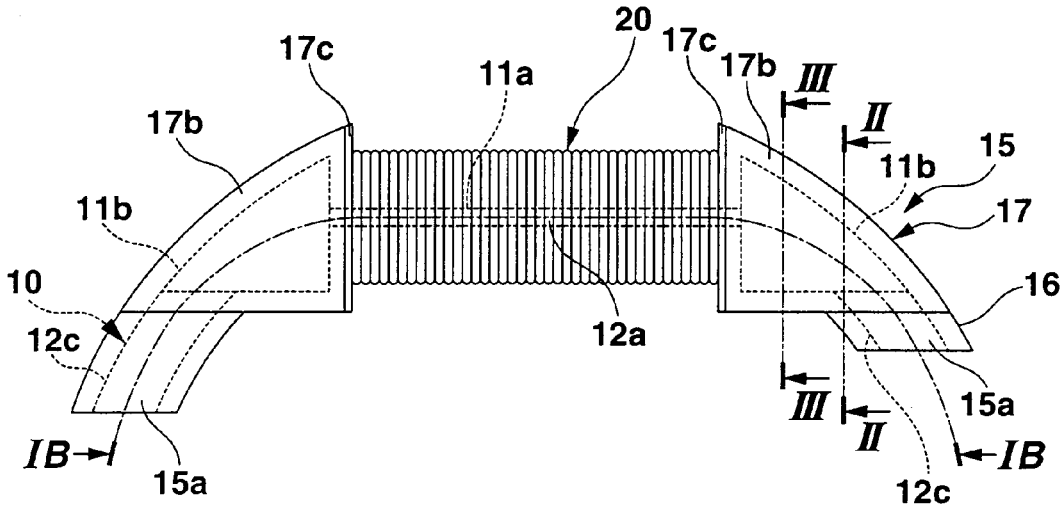
FIG. 1A is a schematic plane view of one embodiment of an antenna wave according to the present invention.
Figure 1B:
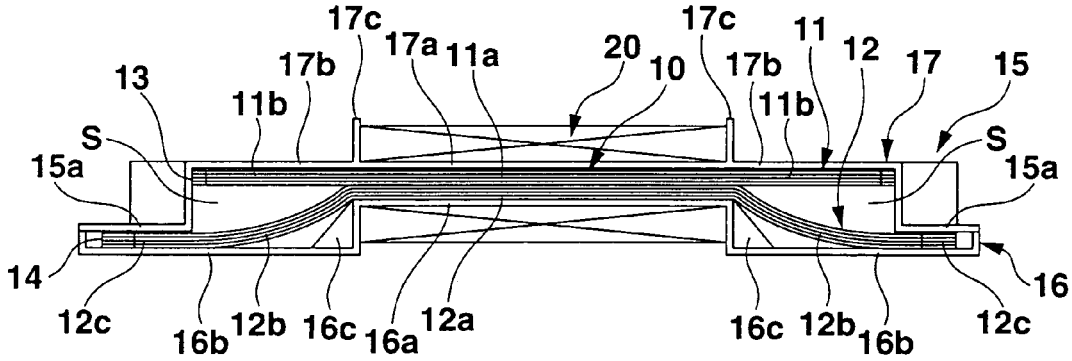
FIG. 1B is a schematic longitudinal sectional view taken along a line IB—IB in FIG. 1A.

As shown in FIGS. 1A and 1B, this antenna comprises an elongate laminated core 10, a core case 15 having an electrical insulating property and configured to house the laminated core 10, and a coil 20 wound around the laminated core 10 between both end portions of the laminated core 10 through the core case 15.

In particular, the laminated core 10 comprises a first group 13 including a plurality of amorphous soft magnetic alloy thin plates 11 laminated each other, and a second group 14 including a plurality of amorphous soft magnetic alloy thin plates 12 laminated each other separately from the first group 13. The first and second groups 13 and 14 are stacked with one another to form the elongate laminated core 10. In this embodiment, a whole of the laminated core 10 has a substantially arc shape.

Figure 4:
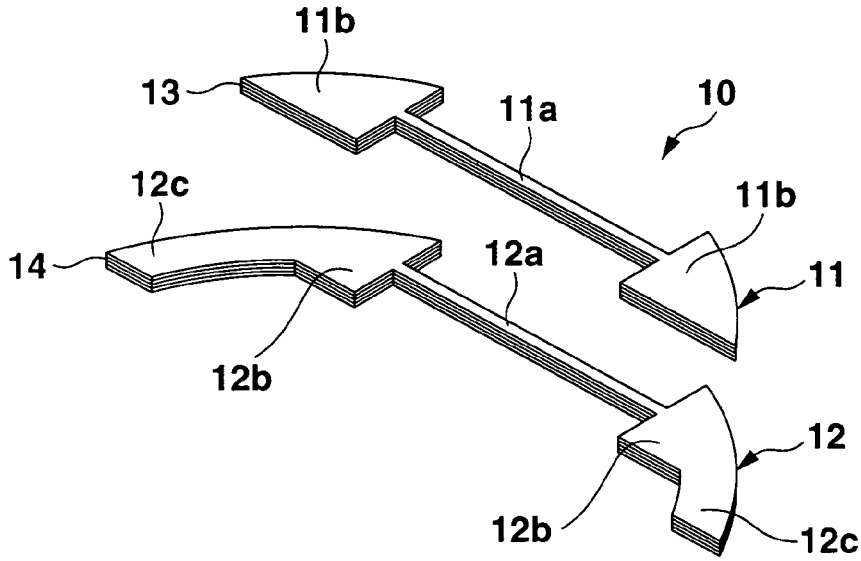
FIG. 4 is a schematic perspective view of a laminated core used in the embodiment of the antenna of FIG. 1A, the laminated core being separated into two groups in the laminating direction.

As shown well in FIG. 4, each of the thin plates 11 of the first group 13 is shorter than that of the thin plates 12 of the second group 14. Each of the thin plates 11 of the first group 13 includes a flat narrow substantially straight coil wound portion 11*a*, and substantially triangular wide flanges 11*b* provided at both ends of the coil wound portion 11*a*. Each of the thin plates 12 of the second group 14 includes a flat narrow substantially straight coil wound portion 12*a*, substantially triangular wide flanges 12*b* provided at both ends of the coil wound portion 12*a*, and outwardly extending portions 12*c* extended in arcs from the flanges 12*b* at the both ends.

When the first and second groups 13 and 14 are stacked with one another to form the laminated core 10, the coil wound portions 11*a* and flanges 11*b* of the thin plates 11 of the first group 13 are laid on the coil wound portions 12*a* and flanges 12*b* of the thin plates 12 of the second group 14, and the outwardly extending portions 12*c* of the thin plates 12 of the second group 14 extend outwardly from the flanges 11*b* of the thin plates 11 of the first group 13.

As shown in FIGS. 1A and 1B, the core case 15 includes projections 15*a*, which presses the both end portions of the thin plates 12 of the second group 14 to separate from the both ends of the thin plates 11 of the first group 13 in the laminating direction of the thin plates 11 and 12 in the laminated core 10 while the laminated core 10 is housed in the core case 15.

In particular, in this embodiment, the core case 15 is made of nonconductive synthetic resin, and comprises a first case part 16, in which the coil wound portions 11*a* and 12*a* of the thin plates 11 and 12 of the laminated core 10 are placed, and a second case part 17 to be combined with the first case part 16 after the coil wound portions 11*a* and 12*a* of the thin plates 11 and 12 of the laminated core 10 are placed in the first case part 16.

The projections 15*a* are provided on the second case part 17 at positions corresponding to the both ends of the thin plates 12 of the second group 14 of the laminated core 10 when the second case part 17 is combined with the first case part 16.

Figure 5:
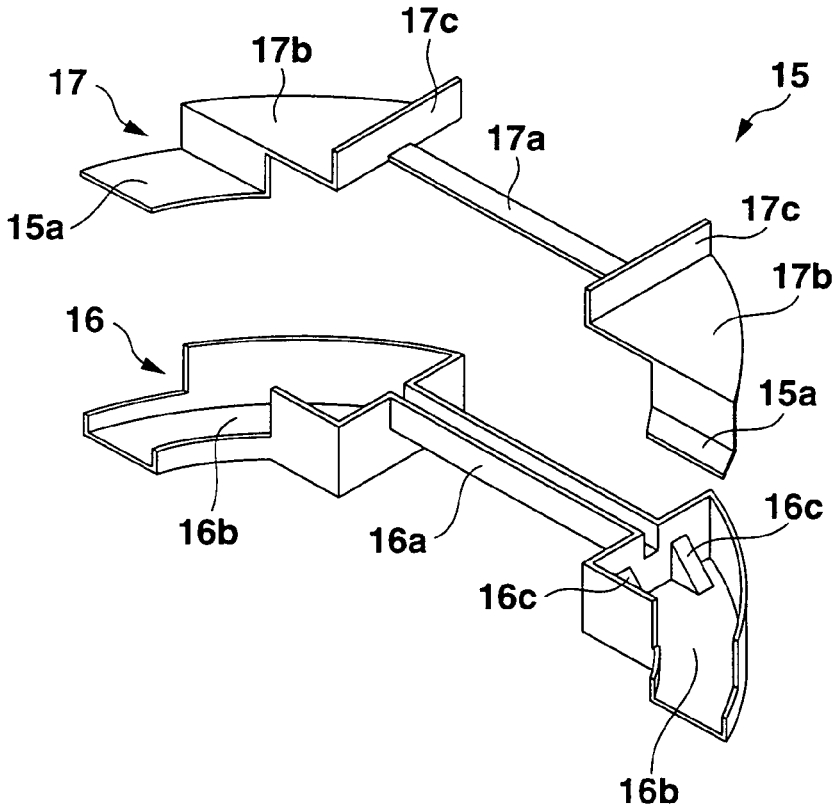
FIG. 5 is a schematic exploded perspective view of a core case used in the embodiment of the antenna of FIG. 1A to house the laminated core shown in FIG. 4, with a case cover being separated from a case body.

In more particular, as shown well in FIG. 5, the first case part 16 of the core case 15 comprises a linear trough-like coil wound portion receiving part 16*a* which houses all of the coil wound portions 11*a* and 12*a* of the thin plates 11 and 12 of the laminated core 10 when the coil wound portions 11*a* and 12*a* of the thin plates 11 and 12 of the laminated core 10 are placed thereon. The coil wound portion receiving part 16*a* is provided with flange portion/outwardly extending portion receiving parts 16*b* at the both ends thereof. The flange portion/outwardly extending portion receiving parts 16*b* house all of the outwardly extending portions 12*c* and flanges 11*b* and 12*b* at the both end portions of the thin plates 11 and 12 of the laminated core 10 when the coil wound portions 11*a* and 12*a* of the thin plates 11 and 12 of the laminated core 10 are placed on the coil wound portion receiving part 16*a* of the core case 15.

The bottom wall of the flange/outwardly extending portion receiving part 16*b* is placed far away from the bottom wall of the coil wound portion receiving part 16*a* along the laminating direction of the thin plates 11 and 12 of the laminated core 10 when the coil wound portions 11*a* and 12*a* of the thin plates 11 and 12 are placed on the coil wound portion receiving part 16*a*. As a result, a step is generated in the laminating direction between the bottom wall of the coil wound portion receiving part 16*a* and the bottom wall of the flange/outwardly extending portion receiving part 16*b*. On the inside surface of the step, there is provided with slopes 16*c* each having a surface inclined gently from the inside surface of the bottom wall of the coil wound portion receiving part 16*a* toward the inside surface of the bottom wall of the flange/outwardly extending portion receiving part 16*b*.

The above described coil wound portion receiving part 16*a* and flange/outwardly extending portion receiving parts 16*b* of the first case part 16 form a case body, which has an opening to expose the outside surfaces of the coil wound portion 11*a* and flanges 11*b* of the thin plate 11 positioned at the outer end of the laminated core 10 while the coil wound portions 11*a* and 12*a* of the laminated core 10 are placed on the coil wound portion receiving part 16*a* of the first case part 16.

The second case part 17 of the core case 15 includes a case cover to cover the opening of the case body formed by the first case part 16.

The case cover of the second case part 17 includes a flat elongate linear coil wound portion cover 17*a*, which covers the opening of the coil wound portion receiving part 16*a* of the first case part 16, and two flange/outwardly extending portion covers 17*b*, which are provided at the both ends of the coil wound portion cover 17*a* and cover the openings of the flange/outwardly extending portion receiving parts 16*b* of the first case part 16.

In the flange/outwardly extending portion covers 17*b*, outward portions corresponding to the outwardly extending portions 12*c* at the both ends of the thin plates 12 in the second group 14 of the laminated core 10 housed in the first case part 16 are stepped to inward portions corresponding to the flanges 11*b* at the both ends of the thin plates 11 in the first group 13 of the laminated core 10 housed in the first case part 16, so as to be placed closer to the inside surfaces of the bottom walls of the flange/outwardly extending portion receiving parts 16*b* of the first case part 16 than the inward portions, and form the projections 15*a* of the core case 15.

On each of the flange/outwardly extending portion covers 17*b*, a coil winding frame 17*c* is formed at an edge adjacent to the coil wound portion cover 17*a*. The coil winding frame 17*c* rises from the outside surface of each of the flange/outwardly extending portion covers 17*b*.

Figure 6A:
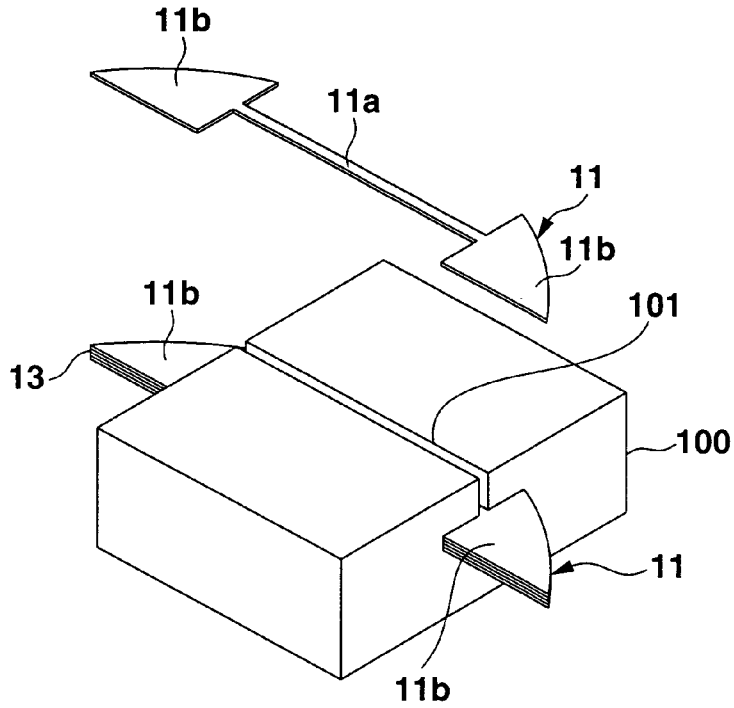
FIG. 6A is a schematic perspective view showing a first group preparing process in a method of manufacturing the embodiment of the antenna of FIG. 1A, in that process one of two groups of the laminated core shown in FIG. 4 being prepared.

FIG. 6A shows a laminating jig 100, which is used in a first group preparing step for preparing the first group 13 of the laminated core 10. A slit 101 is formed on the laminating jig 100. And, the slit 101 has the same width and length as those of the coil wound portion 11*a* of each of the thin plates 11 in the first group 13, and the value of the depth of the slit 101 is the same or greater than that of the total thickness of the predetermined number of thin plates 11 included in the first group 13.

In the first group preparing step, the coil wound portions 11*a* of a predetermined number of thin plates 11 included in the first group 13 are sequentially put into the slit 101, and the predetermined number of thin plates 11 included in the first group are laminated with each other, thereby the first group 13 is prepared.

The width, length and thickness of each of the coil wound portions 12*a* of the thin plates 12 in the second group 14 are the same as those of each of the coil wound portions 11*a* of the thin plates 11 in the first group 13. Therefore, the laminating jig 100 can be used also in a second group preparing step for preparing the second group 14 of the laminated core 10.

Figure 6B:
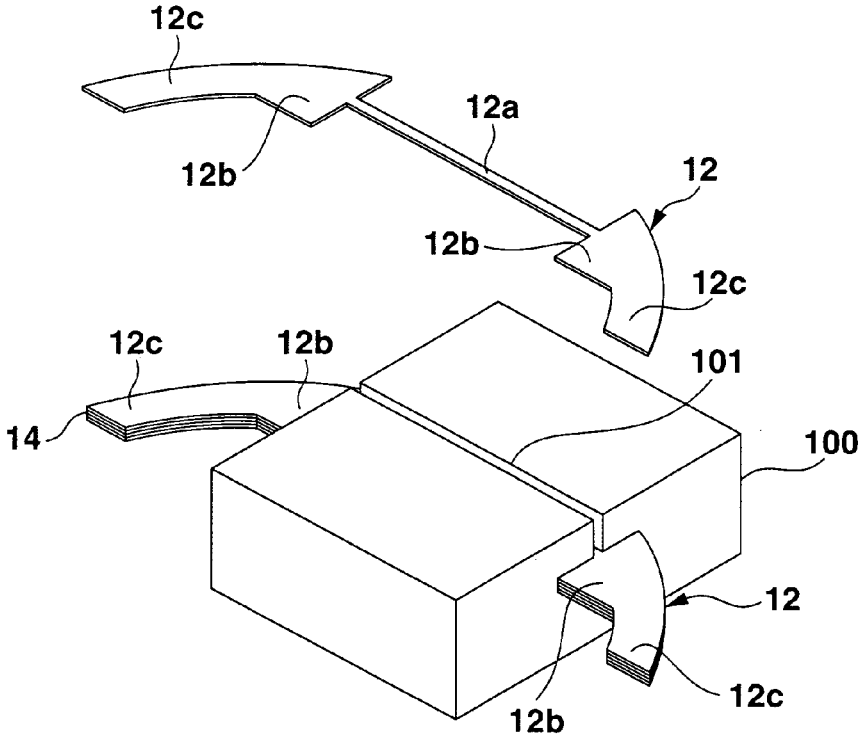
FIG. 6B is a schematic perspective view showing a second group preparing process in the method of manufacturing the embodiment of the antenna of FIG. 1A, in that process the other of the two groups of the laminated core shown in FIG. 4 being prepared.

In the second group preparing step, as shown in FIG. 6B, the coil wound portions 12*a* of the predetermined number of thin plates 12 included in the second group 14 are sequentially put into the slit 101 of the laminating jig 100, and the predetermined number of thin plates 12 included in the second group 14 are laminated with each other, thereby the second group 14 is prepared.

Figure 7:
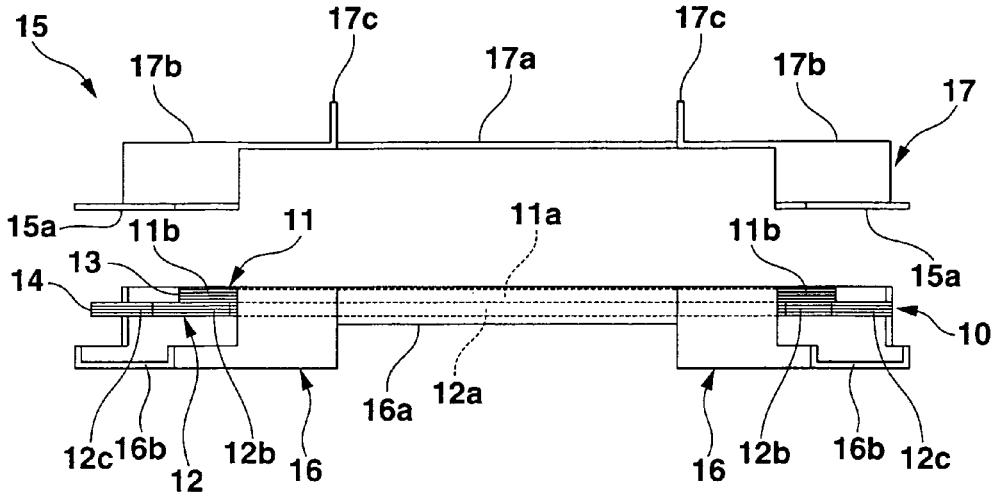
FIG. 7 is a schematic front view showing a laminated core housing process for housing the two groups of the laminated core prepared in the first and second group preparing steps shown in FIGS. 6A and 6B, at a predetermined position in the case body of the core case shown in FIG. 5.

The predetermined number of thin plates 12 of the second group 14 and the predetermined number of thin plates 11 of the first group 13, both of which are prepared as described above, are placed in this order in the first case part 16 as the case body of the core case 15, as shown in FIG. 7.

That is, at first, the coil wound portions 12*a*, flanges 12*b* and outwardly extending portions 12*c* of the predetermined number of thin plates 12 of the second group 14 are housed in the coil wound portion receiving part 16*a* and flange/outwardly extending portion receiving parts 16*b* of the first case part 16. Then, the coil wound portions 11*a* and flanges 11*b* of the predetermined number of thin plates 11 of the first group 13 are housed in the coil wound portion receiving part 16*a* and flange/outwardly extending portion receiving parts 16*b* of the first case part 16.

As a result, the first group 13 is laid on the second group 14 in the first case part 16 as the case body, and the laminated core 10 is formed.

If the value of the depth of the slit 101 of the laminating jig 100 is set to the same or more than that of the total of the thickness of the predetermined number of the thin plates 11 included in the first group 13 and the thickness of the predetermined number of the thin plates 12 included in the second group 14, the coil wound portions 11*a* of the predetermined number of thin plates 11 included in the first group 13 and the coil wound portions 12*a* of the predetermined number of the thin plates 12 included in the second group 14 can be put into the slit 101 of the laminating jig 100. As a result, the first group preparing step and the second group preparing step can be sequentially perform in the laminating jig 100, so that the first group 13 is stacked on the second group 14 to form the laminated core 10.

After the laminated core 10 is formed in the laminating jig 100 as described above, the laminated core 10 can be housed in the first case part 16 as the case body.

Figure 8:
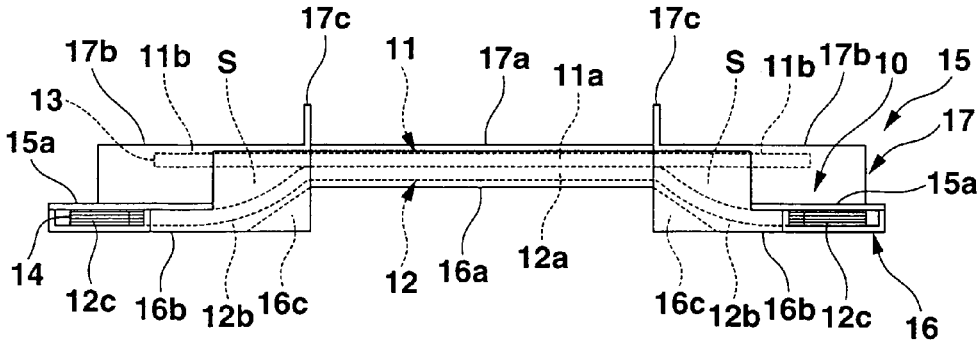
FIG. 8 is a schematic front view showing a deforming process for deforming both end portions of the other group of the laminated core to separate them from both end portions of one group of the laminated core, by closing the case body of the core case with the case cover after the two groups of the laminated core is housed at the predetermined position in the case body as shown in FIG. 7.

The second case part 17 as the case cover is combined with the first case part 16 as shown in FIG. 8 after the laminated core 10 is housed in the first case part 16 as the case body as shown in FIG. 7, the opening of the first case part 16 as the case body is covered with the second case part 17 as the case cover.

Figure 2:
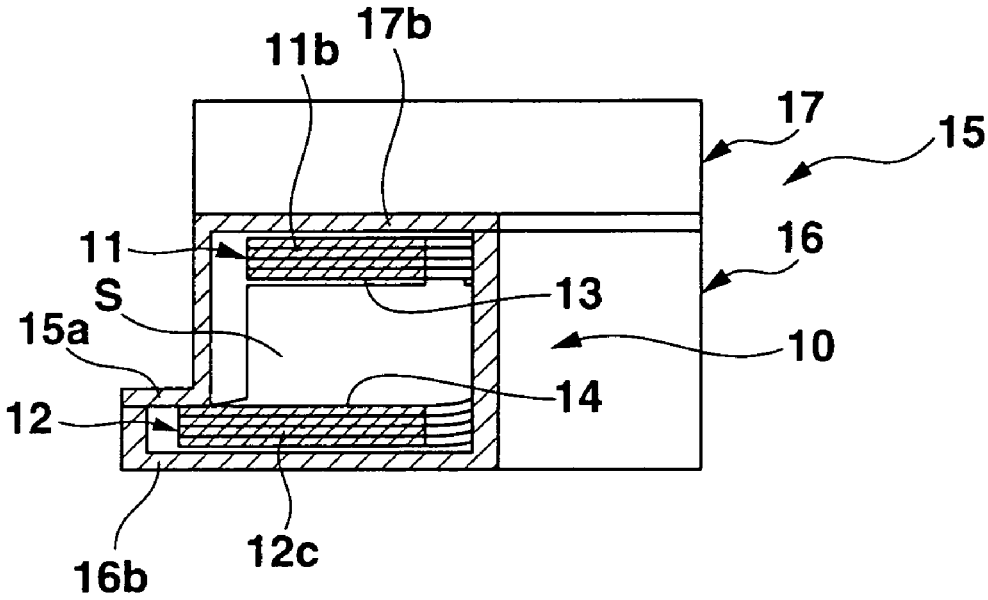
FIG. 2 is a schematic transverse sectional view taken along a line II—II in FIG. 1A.
Figure 3:
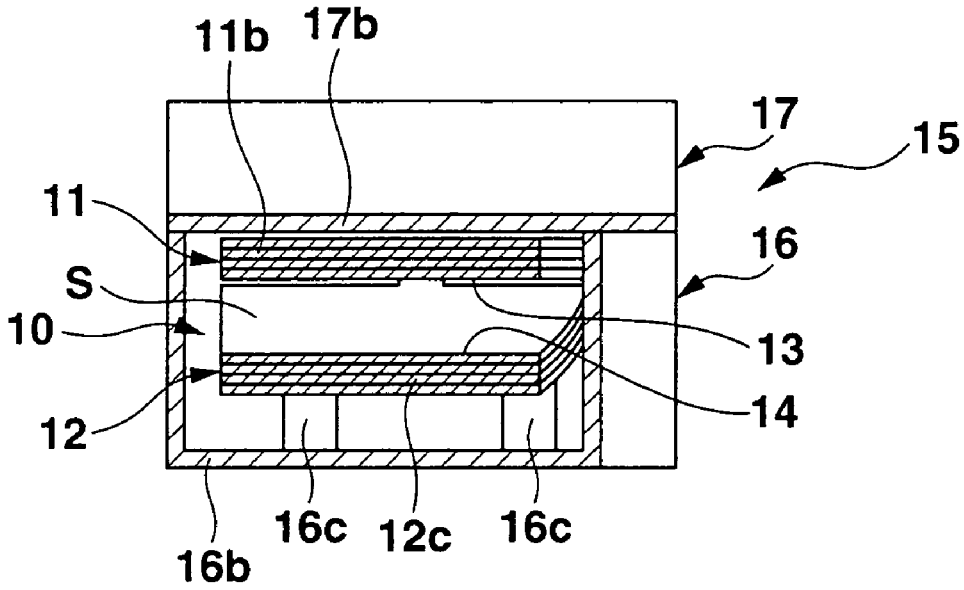
FIG. 3 is a schematic transverse sectional view taken along a line III—III in FIG. 1A.

As a result, the projections 15*a* at the both ends of the second case part 17 as the case cover push the outwardly extending portions 12*c* at the both ends of the thin plates 12 of the second group 14 of the laminated core 10 to separate from the flanges 11*b* at the both ends of the thin plates 11 of the first group 13 in the laminating direction of the laminated core 10. As shown in FIGS. 2 and 3, in addition to FIG. 8, at each of the both ends of the coil wound portion receiving part 16*a* of the first case part 16, each of the flanges 12*b* at the both ends of the thin plates 12 of the second group 14 is bent toward the bottom wall of each of the flange/outwardly extending portion receiving parts 16*b* of the first case part 16, and is arranged along the slopes 16*c* between each of the both ends of the coil wound portion receiving part 16*a* and each of the flange/outwardly extending portion receiving parts 16*b* of the first case part 16.

At the same time, each of the outwardly extending portions 12*c* in the outsides of the flanges 12*b* at the both ends of the thin plates 12 of the second group 14 is arranged along the inside surface of the bottom wall of each of the flange/outwardly extending portion receiving parts 16*b*.

And, a space S is formed between the flanges 11*b* at each of the both ends of the thin plates 11 of the first group 13 and the flanges 12*b* at each of the both ends of the thin plates 12 of the second group 14.

Last of all, as shown in FIG. 1B, the coil 20 is formed by winding an electric wire (UEW) with a predetermined diameter by a predetermined times around the coil wound portion receiving part 16*a* of the first case part 16 and the coil wound portion cover 17*a* of the second case part 17, between the flange/outwardly extending portion receiving parts 16*b* at the both ends of the coil wound portion receiving part 16*a* of the first case part 16 and the coil winding frames 17*c* at the both ends of the coil wound portion cover 17*a* of the second case part 17.

In the embodiment of the antenna for receiving the standard time radio waves configured as described above, the space S formed between the flanges 11*b* at each of the both ends of the thin plates 11 of the first group 13 and the flanges 12*b* at each of the both ends of the thin plates 12 of the second group 14 in the laminated core 10 housed in the core case 15 increases the convergency of the radio waves received by the antenna for receiving the standard time radio waves according to the embodiment, and improves the radio wave receiving characteristic of the antenna.

In one example of the above described antenna for receiving the standard time radio waves according to the embodiment, the first group 13 of the laminated core 10 has twenty thin plates 11. Each of the thin plates 11 is formed by pressing a Co-base amorphous soft magnetic alloy with the thickness of 18 μm. The width and length of the coil wound portion 11*a* of each thin plate 11 are 0.5 mm and 9.5 mm. The maximum width and length of each flange 11*b* of each thin plate 11 are 3.3 mm and 4.2 mm. And, the total length of each thin plate 11 is set to 18.5 mm.

The second group 14 of the laminated core 10 also has twenty thin plates 12. Each of the thin plates 12 is formed by pressing the Co-base amorphous soft magnetic alloy with the thickness of 18 μm. The width and length of the coil wound portion 12*a* of each thin plate 12 is 0.5 mm and 9.5 mm. The maximum width of each flange 12*b* of each thin plate 12 is 3.3 mm. The width and length of one outwardly extending portion 12*c* are 1.2 mm and 1.5 mm. The width and length of the other outwardly extending portion 12*c* are 1.2 mm and 3.0 mm. And, the total length of each thin plate 12 is set to 23 mm.

The thin plates 11 and 12 of the first and second groups 13 and 14 are heat treated in a magnetic field before they are laminated, to obtain good soft magnetic character.

The first and second case parts 16 and 17 of the core case 15 are made of liquid crystal polymer (LCP). The height of the step between the inside surface of the bottom wall of the coil wound portion receiving part 16*a* and the inside surface of the bottom wall of each flange/outwardly extending portion receiving part 16*b* of the first case part 16 is set to 1.2 mm.

The total thickness of the laminated core 10 is set to 0.8 mm.

In the laminated core 10 housed in the core case 15, the outwardly extending portions 12*c* at each of the both ends of the thin plates 12 of the second group 14 separate a maximum of 1.0 mm from the flanges 11*b* at each of the both ends of the thin plates 11 of the first group 13 in the laminating direction in the laminated core 10 when the outwardly extending portions 12*c* at each of the both ends of the thin plates 12 of the second group 14 are pushed by one of the projections 15*a* of the second case part 17.

The electric wire (UEW) of the coil 20 is a polyurethane coated copper wire and has a diameter of 0.09 mm. The electric wire is wound 1200 times around the coil wound portions 11*a* of the thin plates 11 of the first group 13 and the coil wound portions 12*a* of the thin plates 12 of the second group 14, with the coil wound portion receiving part 16*a* of the first case part 16 of the core case 15 and the coil wound part cover 17*a* of the second case part 17 interposed therebetween.

The above example of the antenna for receiving the standard time radio waves and a comparative example of the antenna for receiving the standard time radio waves, which has the same configuration as that of the above example of the antenna, excepting that the outwardly extending portions at both ends of the thin plates of the second group of the laminated core housed in the core case are not pressed to separate from the flanges at the both ends of the thin plates of the first group in the laminating direction of the laminated core of the other example, are examined. And, the performance of the example and that of the comparative example are as follows:

| | Inductance (mH) | | Q value | |
|---|---|---|---|---|
| | 40 KHz | 60 KHz | 40 KHz | 60 KHz |
| Example | 23.1 | 23.7 | 88.5 | 79.2 |
| Comparative Example | 21.3 | 21.8 | 76.3 | 68.8 |

According to these results, it is recognized that the Q-value of the example is higher than that of the comparative example by 10 percent in both radio waves of 40 kHz and 60 kHz.

Another Embodiment of Antenna

Next, another embodiment of the antenna according to the present invention will be explained with reference to FIG. 9. The antenna of this embodiment is used for receiving Japanese standard time radio waves.

This antenna comprises an elongate laminated core 25, a core case 35 having an electrical insulating property and configured to house the laminated core 25, and a not-shown coil wound around the laminated core 25 between both end portions of the laminated core 25 through the core case 35.

In particular, the laminated core 25 comprises a first group 23 including a plurality of amorphous soft magnetic alloy thin plates 21 laminated each other, and a second group 24 including a plurality of amorphous soft magnetic alloy thin plates 22 laminated each other separately from the first group 23. The first and second groups 23 and 24 are stacked with one another to form the elongate laminated core 25. In this embodiment, a whole of the laminated core 25 has a substantially arc shape.

Each of the thin plates 21 of the first group 23 is shorter than that of the thin plates 22 of the second group 24. Each of the thin plates 21 of the first group 23 includes a flat narrow substantially straight coil wound portion 21*a*, and substantially triangular wide flanges 21*b* provided at both ends of the coil wound portion 21*a*. Each of the thin plates 22 of the second group 24 includes a flat narrow substantially straight coil wound portion 22*a*, substantially triangular wide flanges 22*b* provided at both ends of the coil wound portion 22*a*, and outwardly extending portions 22*c* extended in arcs from the flanges 22*b* at the both ends.

When the first and second groups 23 and 24 are stacked with one another to form the laminated core 25, the coil wound portions 21*a* and flanges 21*b* of the thin plates 21 of the first group 23 are laid on the coil wound portions 22*a* and flanges 22*b* of the thin plates 22 of the second group 24, and the outwardly extending portions 22*c* of the thin plates 22 of the second group 24 extend outwardly from the flanges 21*b* of the thin plates 21 of the first group 23.

The core case 35 includes projections 35*a*, which presses the both end portions of the thin plates 22 of the second group 24 to separate from the both ends of the thin plates 21 of the first group 23 in the laminating direction of the thin plates 21 and 22 in the laminated core 25 while the laminated core 25 is housed in the core case 35.

In particular, in this embodiment, the core case 35 is made of nonconductive synthetic resin, and comprises a first case part 26, in which the coil wound portions 21*a* and 22*a* of the thin plates 21 and 22 of the laminated core 10 are placed, and a second case part 27 to be combined with the first case part 26 after the coil wound portions 21*a* and 22*a* of the thin plates 21 and 22 of the laminated core 25 are placed in the first case part 26.

The projections 35*a* are provided on the second case part 27 at positions corresponding to the both ends of the thin plates 22 of the second group 24 of the laminated core 25 when the second case part 27 is combined with the first case part 26.

In more particular, the first case part 26 of the core case 35 comprises a linear trough-like coil wound portion receiving part 26*a*, which houses one part of the coil wound portions 21*a* and 22*a* of the thin plates 21 and 22 of the laminated core 25 when the coil wound portions 21*a* and 22*a* of the thin plates 21 and 22 of the laminated core 25 are placed thereon. In this embodiment, for example, that part of the coil wound portions 21*a* and 22*a* of the thin plates 21 and 22, which is housed in the linear trough-like coil wound portion receiving part 26*a*, is the coil wound portions 22*a* of the thin plate 22 of the second group 24. The coil wound portion receiving part 26*a* is provided with flange portion/outwardly extending portion receiving parts 26*b* at the both ends thereof. The flange portion/outwardly extending portion receiving parts 26*b* house the outwardly extending portions 22*c* at the both end portions of the thin plates 22 and one part of the flanges 21*b* and 22*b* at the both end portions of the thin plates 21 and 22 of the laminated core 25 when the coil wound portions 21*a* and 22*a* of the thin plates 21 and 22 of the laminated core 25 are placed on the coil wound portion receiving part 26*a* of the first case part 26. In this embodiment, for example, that part of the flanges 21*b* and 22*b* at the both end portions of the thin plates 21 and 22, which is housed in the flange portion/outwardly extending portion receiving parts 26*b*, is the flanges 22*b* at the both end portions of the thin plates 22 of the second group 24.

The bottom wall of the flange/outwardly extending portion receiving part 26*b* is placed far away from the bottom wall of the coil wound portion receiving part 26*a* along the laminating direction of the thin plates 21 and 22 of the laminated core 25 when the coil wound portions 21*a* and 22*a* of the thin plates 21 and 22 are placed on the coil wound portion receiving part 26*a*. As a result, a step is generated in the laminating direction between the bottom wall of the coil wound portion receiving part 26*a* and the bottom wall of the flange/outwardly extending portion receiving part 26*b*. On the inside surface of the step, there is provided with slopes 26*c* each having a surface inclined gently from the inside surface of the bottom wall of the coil wound portion receiving part 26*a* toward the inside surface of the bottom wall of the flange/outwardly extending portion receiving part 26*b*.

The above described coil wound portion receiving part 26*a* and flange/outwardly extending portion receiving parts 26*b* of the first case part 26 form a first case body.

The second case part 27 of the core case 35 comprises a linear trough-like coil wound portion receiving part 27*a*, which houses the other part of the coil wound portions 21*a* and 22*a* of the thin plates 21 and 22 of the laminated core 25 when the coil wound portions 21*a* and 22*a* of the thin plates 21 and 22 of the laminated core 25 are placed on the coil wound portion receiving part 26*a* of the first case part 26. In this embodiment, for example, the other part of the coil wound portions 21*a* and 22*a* of the thin plates 21 and 22, which is housed in the linear trough-like coil wound portion receiving part 27*a*, is the coil wound portions 21*a* of the thin plate 21 of the first group 23. The coil wound portion receiving part 27*a* is provided with flange portion/outwardly extending portion receiving parts 27*b* at the both ends thereof. The flange portion/outwardly extending portion receiving parts 27*b* house the other part of the flanges 21*b* and 22*b* at the both end portions of the thin plates 21 and 22 of the laminated core 25 and covers the outwardly extending portions 22*c* at the both end portions of the thin plates 22 of the second group 24 when the coil wound portions 21*a* and 22*a* of the thin plates 21 and 22 of the laminated core 25 are placed on the coil wound portion receiving part 26*a* of the first case part 26. In this embodiment, for example, the other part of the flanges 21*b* and 22*b* at the both end portions of the thin plates 21 and 22, which is housed in the flange portion/outwardly extending portion receiving parts 27*b*, is the flanges 21*b* at the both end portions of the thin plates 21 of the first group 23.

The above described coil wound portion receiving part 27*a* and flange/outwardly extending portion receiving parts 27*b* of the second case part 27 form a second case body.

In the flange/outwardly extending portion receiving parts 27*b*, outward portions corresponding to the outwardly extending portions 22*c* at the both ends of the thin plates 22 in the second group 24 of the laminated core 25 housed in the first case part 26 are stepped to inward portions corresponding to the flanges 21*b* at the both ends of the thin plates 21 in the first group 23 of the laminated core 25 housed in the first case part 26, so as to be placed closer to the inside surfaces of the bottom walls of the flange/outwardly extending portion receiving parts 26*b* of the first case part 26 than the inward portions, and form the projections 35*a* of the core case 35.

On each of the flange/outwardly extending portion receiving parts 27*b*, a coil winding frame 27*c* is formed at an edge adjacent to the coil wound portion receiving part 27*a*. The coil winding frame 27*c* rises from the outside surface of each of the flange/outwardly extending portion receiving parts 27*b*.

Each of the first group 23 and the second group 24 of the laminated core 25 can be prepared easily and speedy by using the laminating jig 100 shown in FIGS. 6A and 6B, like each of the first group 13 and the second group 14 of the laminated core 15 of the antenna of the one embodiment described above with reference to FIGS. 1A to 8.

The predetermined number of thin plates 22 of the second group 24 and the predetermined number of thin plates 21 of the first group 23, both of which are prepared as described above, are placed in this order in the first case part 26 as the first case body of the core case 35.

That is, at first, the coil wound portions 22*a*, flanges 22*b* and outwardly extending portions 22*c* of the predetermined number of thin plates 22 of the second group 24 are housed in the coil wound portion receiving part 26*a* and flange/outwardly extending portion receiving parts 26*b* of the first case part 26. Then, the coil wound portions 21*a* and flanges 21*b* of the predetermined number of thin plates 21 of the first group 23 are stacked on the coil wound portions 22*a* and flanges 22*b* of the predetermined number of thin plates 22 of the first group 24.

As a result, the first group 23 is laid on the second group 24 in the first case part 26 as the first case body, and the laminated core 25 is formed. At this time, the first group 23 is projected into the outer space from the coil wound portion receiving part 26*a* and flange/outwardly extending portion receiving parts 26*b* of the first case part 26 and exposed thereto.

Then, the second case part 27 as the second case body is combined with the first case body 26, so that the exposed coil wound portions 21*a* and flanges 21*b* of the predetermined number of thin plates 21 of the first group 23 of the laminated core 25 is covered by and housed in the coil wound portion receiving part 27*a* and flange/outwardly extending portion receiving parts 27*b* of the second case part 27.

At this time, the projections 35*a* at the both ends of the second case part 27 as the second case body push the outwardly extending portions 22*c* at the both ends of the thin plates 22 of the second group 24 of the laminated core 25 to separate from the flanges 21*b* at the both ends of the thin plates 21 of the first group 23 in the laminating direction of the laminated core 25. As a result, at each of the both ends of the coil wound portion receiving part 26*a* of the first case part 26, each of the flanges 22*b* at the both ends of the thin plates 22 of the second group 24 is bent toward the bottom wall of each of the flange/outwardly extending portion receiving parts 26*b* of the first case part 26, and is arranged along the slopes 26*c* between each of the both ends of the coil wound portion receiving part 26*a* and each of the flange/outwardly extending portion receiving parts 26*b* of the first case part 26.

At the same time, each of the outwardly extending portions 22*c* in the outsides of the flanges 22*b* at the both ends of the thin plates 22 of the second group 24 is arranged along the inside surface of the bottom wall of each of the flange/outwardly extending portion receiving parts 26*b*.

And, a space is formed between the flanges 21*b* at each of the both ends of the thin plates 21 of the first group 23 and the flanges 22*b* at each of the both ends of the thin plates 22 of the second group 24.

Last of all, the coil, which is not shown, is formed by winding an electric wire (UEW) with a predetermined diameter by a predetermined times around the coil wound portion receiving part 26*a* of the first case part 26 and the coil wound portion receiving part 27*a* of the second case part 27, between the flange/outwardly extending portion receiving parts 26*b* at the both ends of the coil wound portion receiving part 26*a* of the first case part 26 and the coil winding frames 27*c* at the both ends of the coil wound portion receiving part 27*a* of the second case part 27.

In another embodiment of the antenna for receiving the standard time radio waves configured as described above, the space formed between the flanges 21*b* at each of the both ends of the thin plates 21 of the first group 23 and the flanges 22*b* at each of the both ends of the thin plates 22 of the second group 24 in the laminated core 25 housed in the core case 35 increases the convergency of the radio waves received by the antenna for receiving the standard time radio waves according to another embodiment, and improves the radio wave receiving characteristic of the antenna.

In one example of the above described antenna for receiving the standard time radio waves according to another embodiment, the first group 23 of the laminated core 25 has twenty thin plates 21. Each of the thin plates 21 is formed by pressing a Co-base amorphous soft magnetic alloy with the thickness of 18 μm. The width and length of the coil wound portion 21*a* of each thin plate 21 are 0.6 mm and 11.5 mm. The width and length of each flange 21*b* of each thin plate 21 are 3.3 mm and 3.2 mm. And, the total length of each thin plate 21 is set to 17.9 mm.

The second group 24 of the laminated core 25 also has twenty thin plates 22. Each of the thin plates 22 is formed by pressing the Co-base amorphous soft magnetic alloy with the thickness of 18 μm. The width and length of the coil wound portion 22*a* of each thin plate 22 is 0.6 mm and 11.5 mm. The width of each flange 22*b* of each thin plate 22 is 3.3 mm. The width and length of one outwardly extending portion 22*c* are 1.4 mm and 3.4 mm. The width and length of the other outwardly extending portion 22*c* are 1.4 mm and 3.4 mm. And, the total length of each thin plate 22 is set to 20 mm.

The thin plates 21 and 22 of the first and second groups 23 and 24 are heat treated in a magnetic field before they are laminated, to obtain good soft magnetic character.

The first and second case parts 26 and 27 of the core case 35 are made of liquid crystal polymer (LCP). The height of the step between the inside surface of the bottom wall of the coil wound portion receiving part 26*a* and the inside surface of the bottom wall of each flange/outwardly extending portion receiving part 26*b* of the first case part 26 is set to 1.2 mm.

The total thickness of the laminated core 25 is set to 0.8 mm.

In the laminated core 25 housed in the core case 35, the outwardly extending portions 22*c* at each of the both ends of the thin plates 22 of the second group 24 separate a maximum of 0.8 mm from the flanges 21*b* at each of the both ends of the thin plates 21 of the first group 23 in the laminating direction in the laminated core 25 when the outwardly extending portions 22*c* at each of the both ends of the thin plates 22 of the second group 24 are pushed by one of the projections 35*a* of the second case part 27.

The electric wire (UEW) of the not shown coil is a polyurethane coated copper wire and has a diameter of 0.08 mm. The electric wire is wound 1600 times around the coil wound portions 21*a* of the thin plates 21 of the first group 23 and the coil wound portions 22*a* of the thin plates 22 of the second group 24, with the coil wound portion receiving part 26*a* of the first case part 26 of the core case 35 and the coil wound portion receiving part 27*a* of the second case part 27 interposed therebetween.

And, the performance of another example of the antenna for receiving the standard time radio waves described above is as follows:

| | Inductance (mH) | | Q value | |
|---|---|---|---|---|
| | 40 KHz | 60 KHz | 40 KHz | 60 KHz |
| Another Example | 40.1 | 41.8 | 85.0 | 78.0 |

According to these results, it is recognized that the Q-value of another example is higher than that of the above described comparative example, which is compared to the above described example of the antenna of one embodiment, by the value more than 10 percent in both radio waves of 40 kHz and 60 kHz.

Watch Provided with Antenna for Receiving Standard Time Radio Waves

Figure 9:
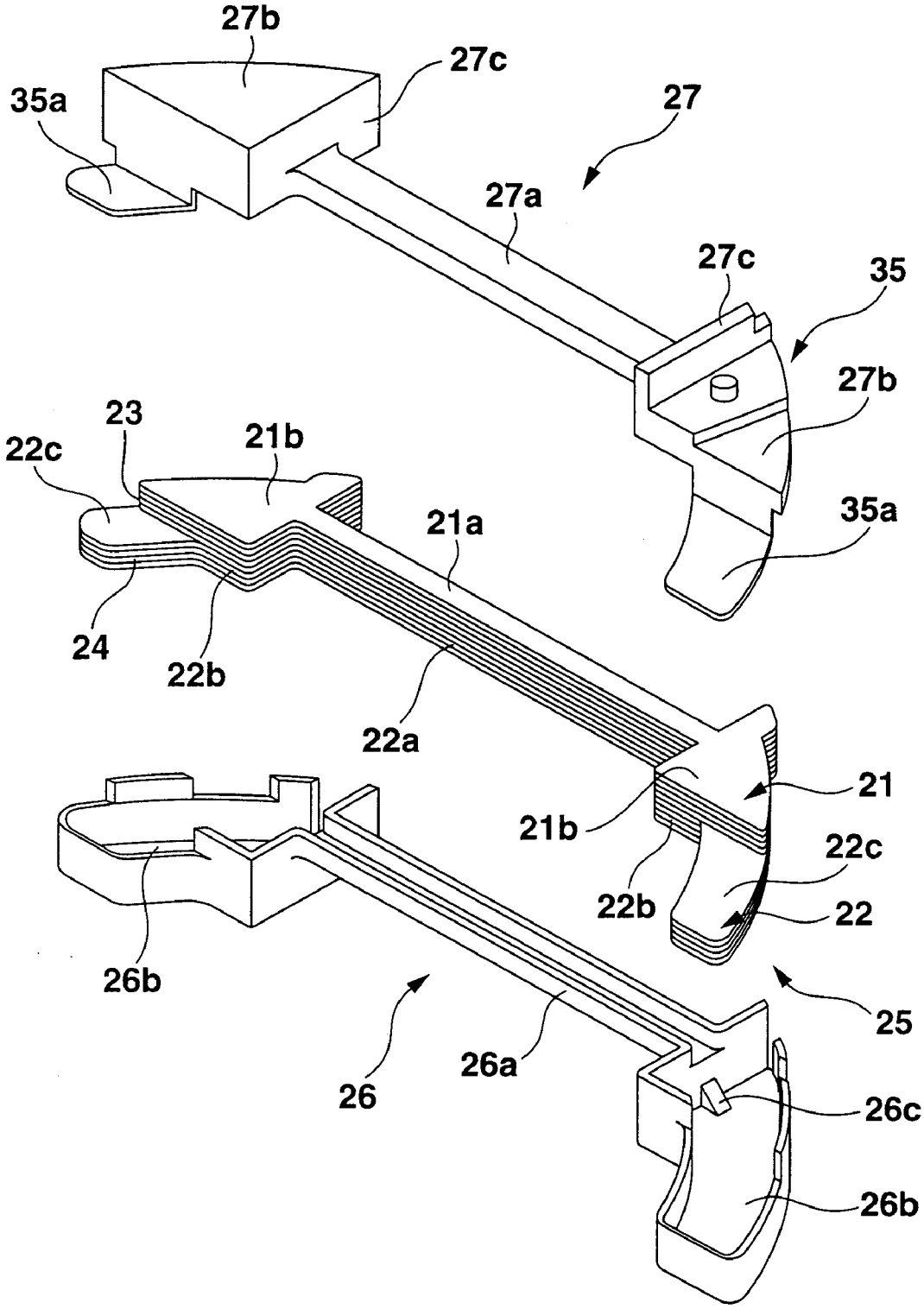
FIG. 9 is a schematic exploded perspective view of a laminated core and core case of another embodiment of the antenna according to the present invention.
Figure 10:
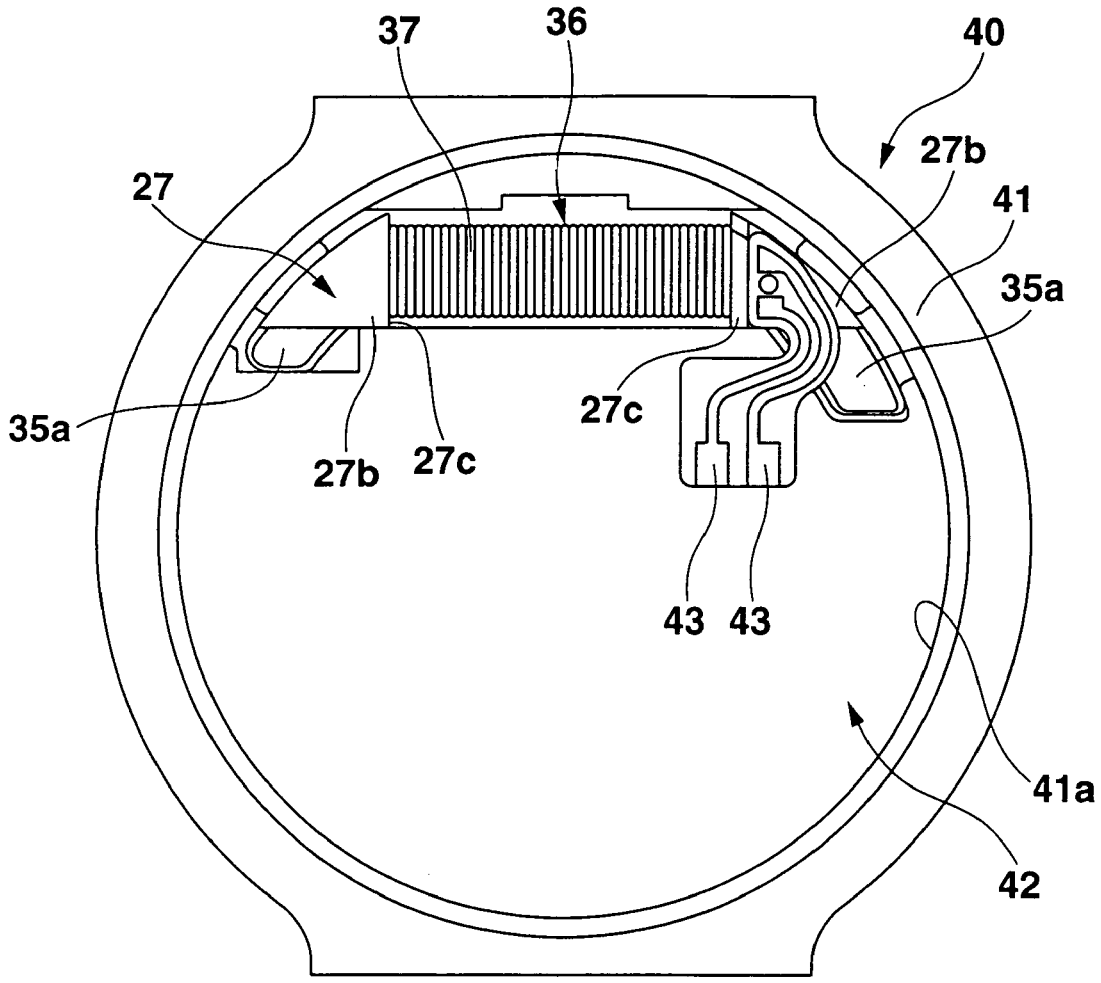
FIG. 10 is a schematic plan view of a case of a wristwatch containing the another embodiment of the antenna according to the present invention and shown in FIG. 9, with a dial and various hands including hour and minute hands of the wristwatch being removed.
Figure 11:
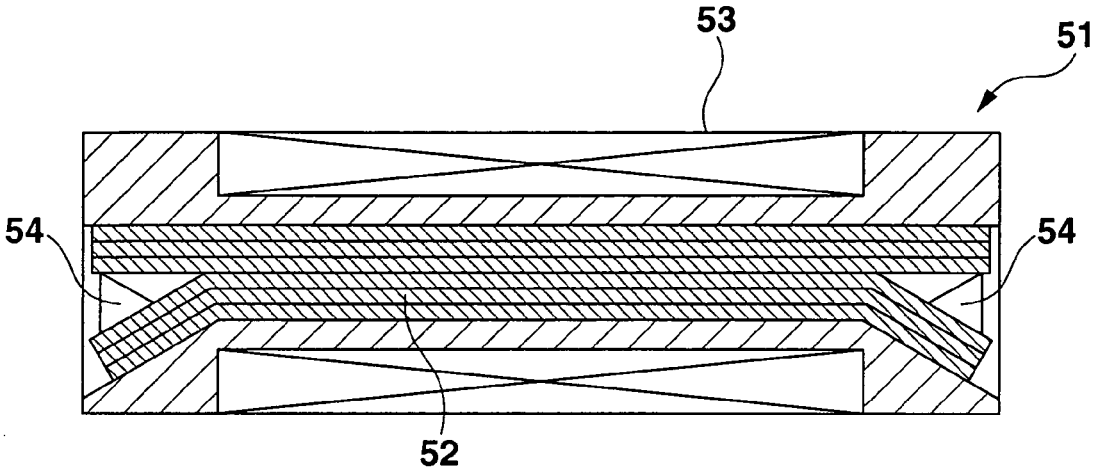
PRIOR ART FIG.11
FIG. 11 is a schematic longitudinal sectional view of one type of a conventional antenna used in a watch type radio controlled timepiece to receive standard time radio waves.
Figure 12:
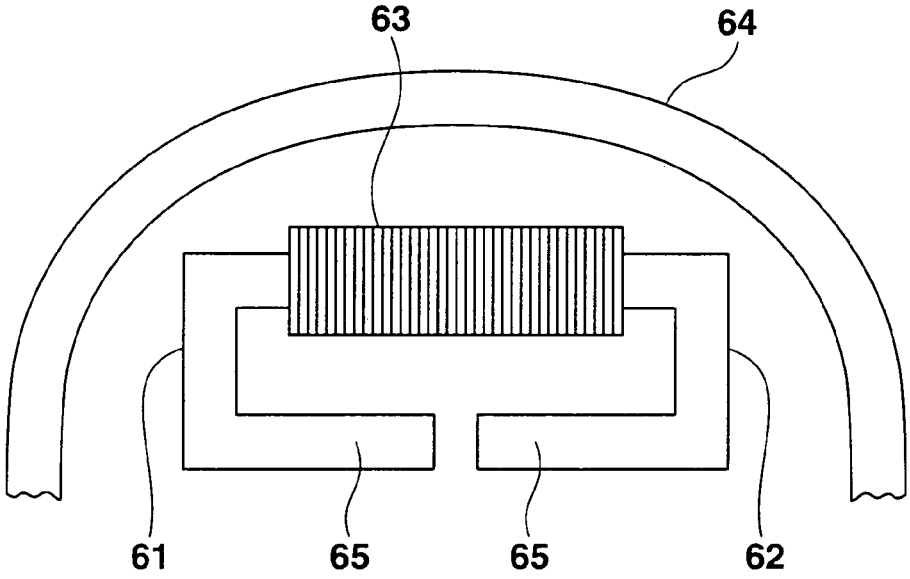
PRIOR ART FIG.12
FIG. 12 is a schematic plane view of another type of the conventional antenna used in the watch type radio controlled timepiece to receive standard time radio waves.

FIG. 10 schematically shows a watchcase 41 of a wristwatch 40 that is a kind of a watch and contains the antenna for receiving standard time radio waves shown in FIG. 9, with a dial and various hands including hour and minute hands being removed.

The antenna is denoted by a reference numeral 36. A coil not shown in FIG. 9 is denoted by a reference numeral 37.

In the inside space of the watchcase 41, a time measuring and displaying mechanism 42 is provided together with a not-shown battery. The time measuring and displaying mechanism 42 has a known configuration. It may be a digital display system using a digital display unit such as a liquid crystal display, as well as an analog display system for displaying time by using a dial and hands including hour and minute hands.

In the inside space housing the time measuring and displaying mechanism 42 together with the not-shown battery, an arc-shaped antenna housing space exists along the internal circumference surface 41*a* of the inside space. The antenna 36 is housed in this antenna housing space. The antenna 36 is connected to the time measuring and displaying mechanism 42 through a flexible wiring plate 43. The time measuring and displaying mechanism 42 corrects the displaying time according to the standard time radio waves received by the antenna 36.

The antenna 36 has the high Q-value as described above, so that it can receive the standard time radio waves sufficiently and satisfactorily even if the watchcase 41 is made of metal such as titanium and stainless steel.

A watch provided with an antenna for receiving a standard time radio wave can be various portable watches including a pocket watch, in addition to the above-described wristwatch 40.

In each of the above described embodiments, the antenna is used for receiving a standard time radio wave. But, the antenna according to this invention can be used for any other electronic devices such as a mobile telephone, a personal digital assistant, etc.

Additional advantages and modifications will readily occur to those skilled in the art. Therefore, the invention in its broader aspect is not limited to the specific details and representative embodiments shown and described herein. Accordingly, various modifications may be made without departing from the spirit or scope of the general inventive concept as defined by the appended claims and their equivalents.

What is claimed is:

1. An antenna comprising:

an elongate laminated core, which has a first group including a plurality of thin plates of amorphous soft magnetic alloy laminated with each other and a second group including a plurality of thin plates of amorphous soft magnetic alloy laminated with each other and which is configured by stacking the first and second groups one another;

a core case, which has an electrical insulating property and houses the laminated core; and a coil, which is wound around the laminated core between both end portions of the laminated core through the core case, wherein each of the thin plates of the laminated core includes flanges provided at both end portions thereof, and a coil wound portion provided between the both end portions, and the core case includes projections, which push the both end portions of the thin plates of the second group to separate from the both end portions of the thin plates of the first group in the laminating direction of the thin plates of the laminated core while the laminated core is housed in the core case.

2. The antenna according to claim 1, wherein the core case has a first case part, on which the coil wound portions of the thin plates of the laminated core are placed, and a second case part, which is combined with the first case part after the coil wound portions of the thin plates of the laminated core are placed on the first case part, and the projections are provided at positions of the second case part corresponding to the both end portions of the thin plates of the second group of the laminated core when the second case part is combined with the first case part.

3. The antenna according to claim 2, wherein the first case part of the core case includes a case body, which houses all of the coil wound portions of the thin plates of the laminated core placed on the first case part and which has an opening exposing the outside surfaces of the flanges and coil wound portion of the thin plate positioned at the outer end in the thin plates of the laminated core, and the second case part of the core case includes a case cover to cover the opening of the case body.

4. The antenna according to claim 2, wherein the first case part of the core case includes a first case body, which houses a part of the coil wound portions of the thin plates of the laminated core placed on the first case part, and the second case part of the core case includes a second case body, which houses the other part of the coil wound portions of the thin plates of the laminated core placed on the first case part.

5. The antenna according to claim 1, wherein the both end portions of the thin plates of the second group of the laminated core include outwardly extending portions extending outwardly from the both end portions of the thin plates of the first group, and the projections of the core case push the outwardly extending portions at the both end portions of the thin plates of the second group of the laminated core.

6. The antenna according to claim 5, wherein the core case has a first case part, on which the coil wound portions of the thin plates of the laminated core are placed, and a second case part, which is combined with the first case part after the coil wound portions of the thin plates of the laminated core are placed on the first case part, and the projections are provided at positions of the second case part corresponding to the outwardly extending portions of the both end portions of the thin plates of the second group of the laminated core when the second case part is combined with the first case part.

7. The antenna according to claim 6, wherein the first case part of the core case includes a case body, which houses all of the coil wound portions of the thin plates of the laminated core placed on the first case part and which has an opening exposing the outside surfaces of the flanges and coil wound portion of the thin plate positioned at the outer end in the thin plates of the laminated core, and the second case part of the core case includes a case cover to cover the opening of the case body.

8. The antenna according to claim 6, wherein the first case part of the core case includes a first case body, which houses a part of the coil wound portions of the thin plates of the laminated core placed on the first case part, and the second case part of the core case includes a second case body, which houses the other part of the coil wound portions of the thin plates of the laminated core placed on the first case part.

9. A watch comprising:

the antenna according to claim 8;

a time measuring and displaying mechanism, which measures and displays the time; and a watchcase, which houses the antenna and the time measuring and displaying mechanism, wherein the antenna receives a standard time radio wave, and the time measuring and displaying mechanism corrects the displaying time according to the standard time radio wave received by the antenna.

10. The watch according to claim 9, wherein the laminated core of the antenna has an arc or hook shape along the inside wall of a space in the watchcase, in which the antenna is housed.

11. A method of manufacturing an antenna, comprising:

preparing a laminated core, in which a first group prepared by laminating elongate thin plates with each other and a second group prepared by laminating elongate thin plates with each other are stacked one another, each elongate thin plate of the first and second group being made of amorphous soft magnetic alloy and provided with flanges at both end portions thereof and a coil wound portion between the both end portions;

housing the laminated core in a core case having an electrically insulating property and having projections, and pushing the both end portions of the thin plates of the second group to separate from the both end portions of the thin plates of the first group in the laminating direction of the thin plates in the laminated core by the projections of the core case; and winding an electric wire around the laminated core between the both end portions of the laminated core housed in the core case through the core case.

12. The method according to claim 11, wherein each of the thin plates of the second group has outwardly extending portions extending outwardly from the both end portions thereof;

preparing the laminated core has preparing a first group by laminating thin plates for the first group with each other, and preparing a second group by laminating thin plates for the second group with each other;

in housing the laminated core, the first group and the second group are housed in the core case with the first group and the second group being stacked one another; and in housing the laminated core, when the first and second groups are housed in the core case with the first and second groups being stacked one another, the projections of the core case push the outwardly extending portions at the both end portions of the thin plates of the second group to separate from the both end portions of the thin plates of the first group in the laminating direction of the thin plates.

13. The method according to claim 12, wherein the core case has a first case part, on which the coil wound portions of the thin plates of the first and second groups are placed, and a second case part, which is combined with the first case part after the coil wound portions of the thin plates are placed on the first case part;

in the second case part, the projections are provided at positions corresponding to the both end portions of the thin plates of the second group of the laminated core when the second case part is combined with the first case part; and in housing the laminated core, the projections of the second case part push the outwardly extending portion at the both end portions of the thin plates of the second group to separate from the both end portions of the thin plates of the first group in the laminating direction of the thin plates when the second case is combined with the first case part after the coil wound portions of the thin plates of the first and second groups are placed on the first case part.

14. The method according to claim 13, wherein the first case part of the core case includes a case body, which houses all of the coil wound portions of the thin plates of the laminated core placed on the first case part and which has an opening exposing the outside surfaces of the flanges and coil wound portion of the thin plate positioned at the outer end of the thin plates of the laminated core;

the second case part of the core case includes a case cover, which has the projections and which covers the opening of the case body; and in housing the laminated core, the projections of the case cover push the outwardly extending portions at the both end portions of the thin plates of the second group to separate from the both end portions of the thin plates of the first group in the laminating direction of the thin plates when the opening of the case body is covered with the case cover after all of the coil wound portions of the thin plates of the laminated core placed on the first case part of the core case are housed in the case body.

15. The method according to claim 13, wherein the first case part of the core case includes a first case body, which houses a part of the coil wound portions of the thin plates of the laminated core placed on the first case part;

the second case part of the core case has the projections, and includes a second case body, which houses the other part of the coil wound portions of the thin plates of the laminated core placed on the first case part; and in housing the laminated core, the projections of the second case body push the outwardly extending portions at the both end portions of the thin plates of the second group to separate from the both end portions of the thin plates of the first group in the laminating direction of the thin plates when the other part of the coil wound portions of the thin plates of the laminated core placed on the first case part are housed in the second case body after the part of the coil wound portions of the thin plates of the laminated core placed on the first case part of the core case.

* * * * *